US009866945B2

(12) United States Patent
McAuliffe et al.

(10) Patent No.: US 9,866,945 B2
(45) Date of Patent: Jan. 9, 2018

(54) ANTENNAS FOR WIRELESS EARBUDS

(71) Applicant: Apple Inc., Cupertino, CA (US)

(72) Inventors: Erin A. McAuliffe, Campbell, CA (US); Carlo Di Nallo, San Carlos, CA (US); Huan-Chu Huang, Taoyuan (TW); Joel D. Barrera, Belmont, CA (US); Mattia Pascolini, San Francisco, CA (US); Jerzy S. Guterman, Mountain View, CA (US); Arun Chawan, San Francisco, CA (US); Benjamin Cousins, Burlington (CA); Lee M. Panecki, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/993,548

(22) Filed: Jan. 12, 2016

(65) Prior Publication Data

US 2017/0201821 A1 Jul. 13, 2017

(51) Int. Cl.

| | |
|---|---|
| ***H04R 25/00*** | (2006.01) |
| ***H04R 1/10*** | (2006.01) |
| ***H01Q 1/22*** | (2006.01) |
| ***H01Q 1/27*** | (2006.01) |
| ***H01Q 9/42*** | (2006.01) |

(52) U.S. Cl.

CPC ..... *H04R 1/1066* (2013.01); *H01Q 1/22* (2013.01); *H01Q 1/273* (2013.01); *H01Q 9/42* (2013.01); *H04R 1/1016* (2013.01)

(58) Field of Classification Search

CPC ..... H04R 2420/07; H04R 1/10; H04R 1/1016

USPC ..... 381/315, 74; 343/893

See application file for complete search history.

(56) References Cited

U.S. PATENT DOCUMENTS

| | | | | |
|---|---|---|---|---|
| 5,799,097 | A | 8/1998 | Lo | |
| 6,944,307 | B2 | 9/2005 | Berg | |
| 7,859,469 | B1 * | 12/2010 | Rosener | H01Q 1/22 343/702 |
| 8,879,722 | B1 | 11/2014 | Wang et al. | |
| 2008/0166004 | A1 * | 7/2008 | Sanford | H01Q 1/243 381/375 |
| 2012/0009983 | A1 * | 1/2012 | Mow | H01Q 1/243 455/575.7 |

(Continued)

FOREIGN PATENT DOCUMENTS

| | | |
|---|---|---|
| EP | 2640170 | 7/2015 |

*Primary Examiner* — Sunita Joshi

(74) *Attorney, Agent, or Firm* — Treyz Law Group, P.C.; G. Victor Treyz; Tianyi He

(57) ABSTRACT

An accessory such as a wireless earbud may have an antenna for transmitting and receiving wireless signals. A housing for the earbud may have a main body portion and an extended portion that forms a stalk protruding from the main body portion. The earbud may have a speaker aligned with a speaker port in the main body portion. The antenna may have an elongated shape and may extend along the stalk. The stalk may have a plastic housing wall portion. The antenna may be formed from first and second metal traces on opposing sides of a printed circuit substrate. The first metal trace may form an antenna resonating element arm and may lie between the substrate and the plastic housing wall portion. The second metal trace may be a ground trace. A feed for the antenna may be located at a juncture between the main body portion and the stalk.

18 Claims, 5 Drawing Sheets

(56) References Cited

U.S. PATENT DOCUMENTS

| | | | | |
|---|---|---|---|---|
| 2012/0244710 | A1* | 9/2012 | Chumakov | H01L 21/0337<br>438/701 |
| 2013/0141305 | A1* | 6/2013 | Leem | H01Q 21/28<br>343/893 |
| 2013/0234899 | A1* | 9/2013 | Pope | H01Q 1/243<br>343/702 |
| 2014/0376735 | A1 | 12/2014 | Asrani et al. | |
| 2015/0245129 | A1 | 8/2015 | Dusan et al. | |

* cited by examiner

ANTENNAS FOR WIRELESS EARBUDS

BACKGROUND

This relates generally to electronic devices and, more particularly, to electronic devices with wireless circuitry.

Electronic devices such as electronic accessories for cellular telephones, computers, and other electronic equipment often include wireless circuitry. For example, earbuds are available that communicate wirelessly with cellular telephones and other equipment.

Challenges can arise in implementing wireless communications circuitry in a compact device such as an earbud. If care is not taken, antennas will not perform effectively. This can make it difficult or impossible to achieve desired levels of wireless communications performance.

It would therefore be desirable to be able to provide devices such as earbuds with improved wireless circuitry.

SUMMARY

An accessory such as a wireless earbud may have an antenna for transmitting and receiving wireless signals. The accessory may have a housing with a main body portion and an extended portion that protrudes outwardly from the main body portion. The main body portion may have a speaker port. A speaker for the earbud may be mounted in the main body portion in alignment with the speaker port. The extended portion may form a stalk that protrudes from the main body portion and that may be grasped by a user when inserting and removing the earbud from the user's ear.

The antenna of the earbud may have an elongated shape and may extend along the stalk. The stalk may have a plastic housing wall that surrounds the antenna.

The antenna may be formed from first and second metal traces on opposing sides of a printed circuit substrate. The first metal trace may form an antenna resonating element arm and may lie between the substrate and the plastic housing wall of the stalk. The second metal trace may be a ground trace.

The antenna may be an inverted-F antenna. A return path via may pass through the printed circuit substrate of the antenna from the first to the second metal trace. The antenna may have a feed that is coupled to a transmission line. The feed may be located at a juncture between the main body portion and the stalk.

Further features will be more apparent from the accompanying drawings and the following detailed description.

DETAILED DESCRIPTION

Figure 1:
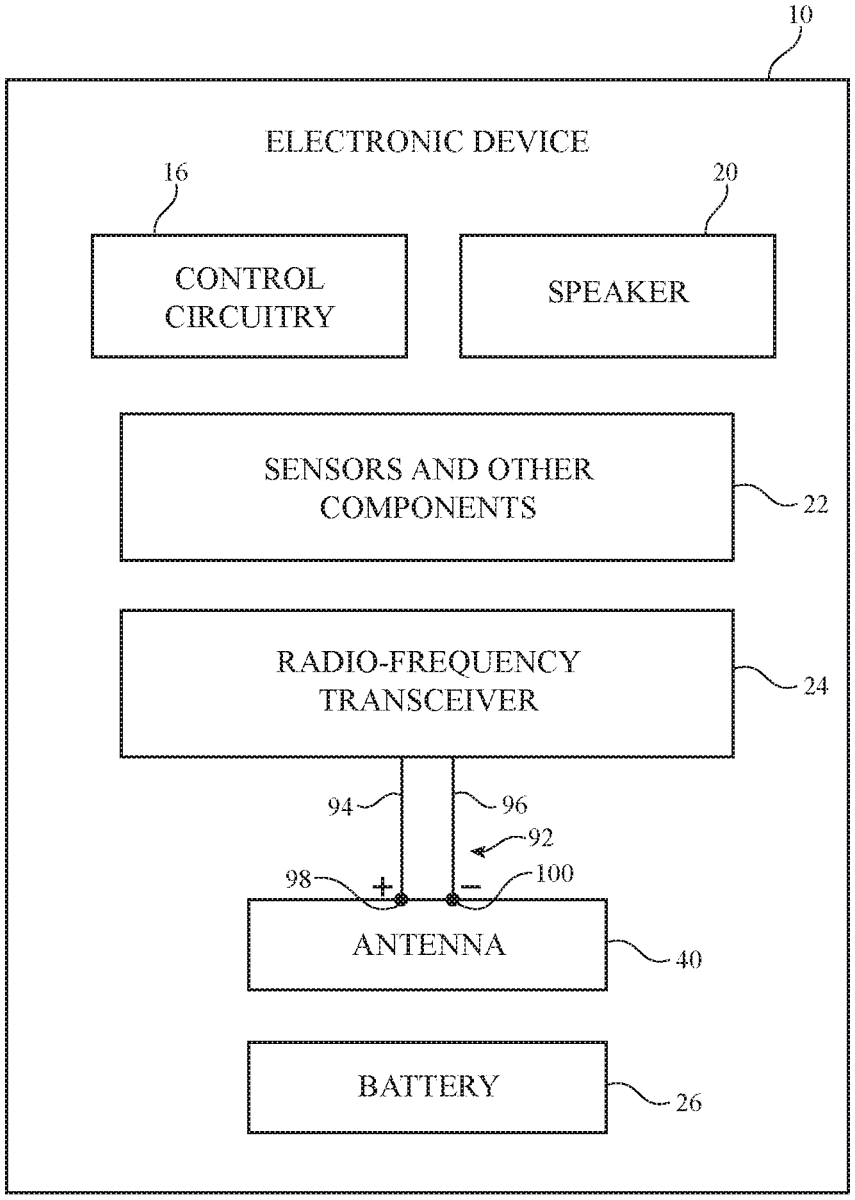
FIG. 1 is a schematic diagram of an illustrative electronic device with wireless circuitry in accordance with an embodiment.

An electronic device of the type that may be provided with wireless circuitry is shown in FIG. 1. Device 10 of FIG. 1 may be a wireless accessory such as a wireless earbud or other small portable accessory of the type that is used in conjunction with another electronic device such as a cellular telephone, portable computer, watch, media player, or other host equipment. If desired, device 10 may be a different type of electronic equipment. Configurations in which device 10 is a wireless accessory may sometimes be described herein as an example.

Devices such as device 10 may communicate wirelessly with external electronic equipment over a wireless communications link. The wireless communications link may be a cellular telephone link (e.g., a wireless link at frequencies of 700 MHz to 2700 MHz or other suitable cellular telephone frequencies), may be a wireless local area network link operating at 2.4 GHz, 5 GHz, or other suitable wireless local area network frequencies, may be a Bluetooth® link operating at 2.4 GHz, may involve millimeter wave communications, may involve near-field communications, or may involve wireless communications in other communications bands. Configurations in which device 10 operates at 2.4 GHz to support short-range communications such as Bluetooth® communications may sometimes be described herein as an example.

As shown in FIG. 1, device 10 (e.g., an earbud or other accessory) may include control circuitry such as storage and processing circuitry 16. Storage and processing circuitry 16 may include storage such as nonvolatile memory (e.g., flash memory or other electrically-programmable-read-only memory configured to form a solid state drive), volatile memory (e.g., static or dynamic random-access-memory), etc. Processing circuitry in storage and processing circuitry 16 may be used to control the operation of device 10. This processing circuitry may be based on one or more microprocessors, microcontrollers, digital signal processors, baseband processor integrated circuits, application specific integrated circuits, etc.

Storage and processing circuitry 16 may be used to run software on device 10. The software may handle communications, may process sensor signals and take appropriate action based on the processed sensor signals (e.g., to turn on or off functions in device 10, to start or stop audio playback, etc.), and may handle other device operations. To support interactions with external equipment, storage and processing circuitry 16 may be used in implementing communications protocols. Communications protocols that may be implemented using storage and processing circuitry 30 include wireless local area network protocols (e.g., IEEE 802.11 protocols—sometimes referred to as WiFi® and WiGig), protocols for other short-range wireless communications links such as the Bluetooth® protocol, cellular telephone protocols, etc.

Device 10 may include microphones, speakers, tone generators, and other audio components (see, e.g., speaker 20). Microphones may gather ambient noise signals for noise cancellation functions. Speakers may play back sound for a user. Tone generators and other sound output devices may generate other audible output. Sensors and other components 22 in device 10 may include proximity sensors (e.g., capacitive proximity sensors, light-based proximity sensors, etc.), force sensors, buttons, magnetic sensors, accelerometers and other components for measuring device orientation and/or motion, strain gauge sensors, vibrators, etc. Control circuitry 16 may use input-output circuitry such as speaker 20 and/or sensors and other components 22 to gather input from a user and/or the environment surrounding device 10. In response, control circuitry 16 may transmit wireless signals to remove equipment and may provide a user with audible, visible, and tactile output Device 10 may include battery 26 to provide power to the circuitry of device 10. Battery 26 may be, for example, a rechargeable battery. Battery 26 may be recharged wirelessly (e.g., by providing device 10 with wireless power) or may be recharged via a wired connection between external equipment and device 10. Configurations in which battery 26 is not rechargeable (e.g., in which battery 26 is a replaceable non-rechargeable battery) may also be used.

Electronic device 10 may include wireless circuitry for supporting wireless communications with external equipment. The wireless circuitry may include radio-frequency transceiver 24 and one or more antennas such as antenna 40. Antenna 40 may have a feed that includes positive antenna feed terminal 98 and ground antenna feed terminal 100. Transmission line 92 may be used to couple radio-frequency transceiver circuitry 24 to antenna 40. Transmission line 92 may have a positive signal path such as line 94 and a ground signal path such as line 96. Transmission lines in circuitry 10 such as transmission line 92 may include coaxial cable paths, microstrip transmission lines, stripline transmission lines, edge-coupled microstrip transmission lines, edge-coupled stripline transmission lines, transmission lines formed from combinations of transmission lines of these types, etc. Filter circuitry, switching circuitry, impedance matching circuitry, and other circuitry may be interposed within the transmission lines, if desired.

Antenna 40 may be formed using any suitable antenna type. For example, antenna 40 may be an antenna with a resonating element that is formed from a loop antenna structure, a patch antenna structure, an inverted-F antenna structure, a slot antenna structure, a planar inverted-F antenna structure, a helical antenna structure, a monopole, a dipole, hybrids of these designs, etc. If desired, antenna 40 may include tunable circuitry and control circuitry 16 may be used to select an optimum setting for the tunable circuitry to tune antenna 40. Antenna adjustments may be made to tune antenna 40 to perform in a desired frequency range or to otherwise optimize antenna performance. Sensors may be incorporated into antenna 40 or elsewhere in device 10 to gather sensor data in real time that is used in adjusting antenna 40. Antenna 40 may also be implemented using a fixed (non-tunable) configuration.

Figure 2:
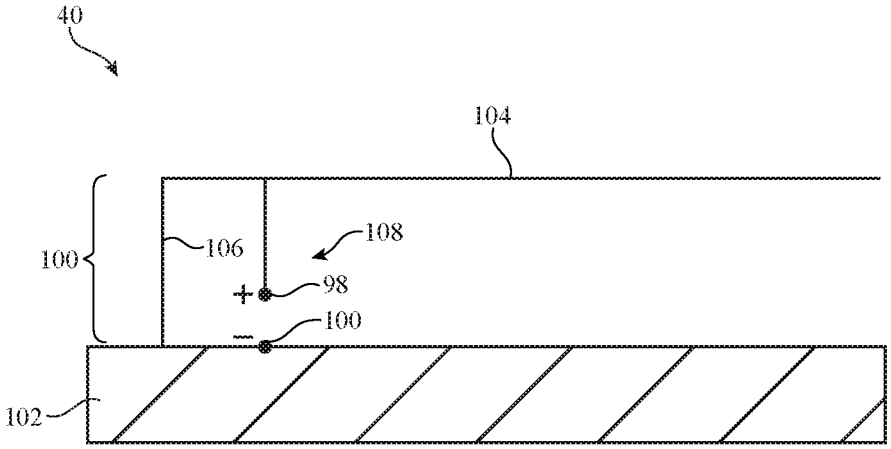
FIG. 2 is a diagram of an illustrative antenna of the type that may be used in an electronic device in accordance with an embodiment.

An illustrative configuration for antenna 40 is shown in FIG. 2. In the example of FIG. 2, antenna 40 is an inverted-F antenna and has inverted-F antenna resonating element 100 and antenna ground 102. Antenna 40 may be fed by coupling transmission line 92 (FIG. 1) to antenna feed 108. Antenna feed 108 has positive antenna feed terminal 98 coupled to resonating element arm 104 of antenna resonating element 100 and has ground antenna feed 100 coupled to ground 102. Return path 106 (i.e., a short circuit path) may be coupled between antenna resonating element arm 104 and ground 102 in parallel with feed 108.

Antenna ground 102 may be formed from ground traces in a printed circuit or other substrate, metal portions of a battery, metal housing structures, metal portions of internal device components, or other conductive ground structures in device 10. Antenna resonating element 100 may be formed from metal printed circuit traces and/or other conductive structures in device 10 (e.g., metal foil, metal housing structures, portions of internal device components, etc.).

Figure 3:
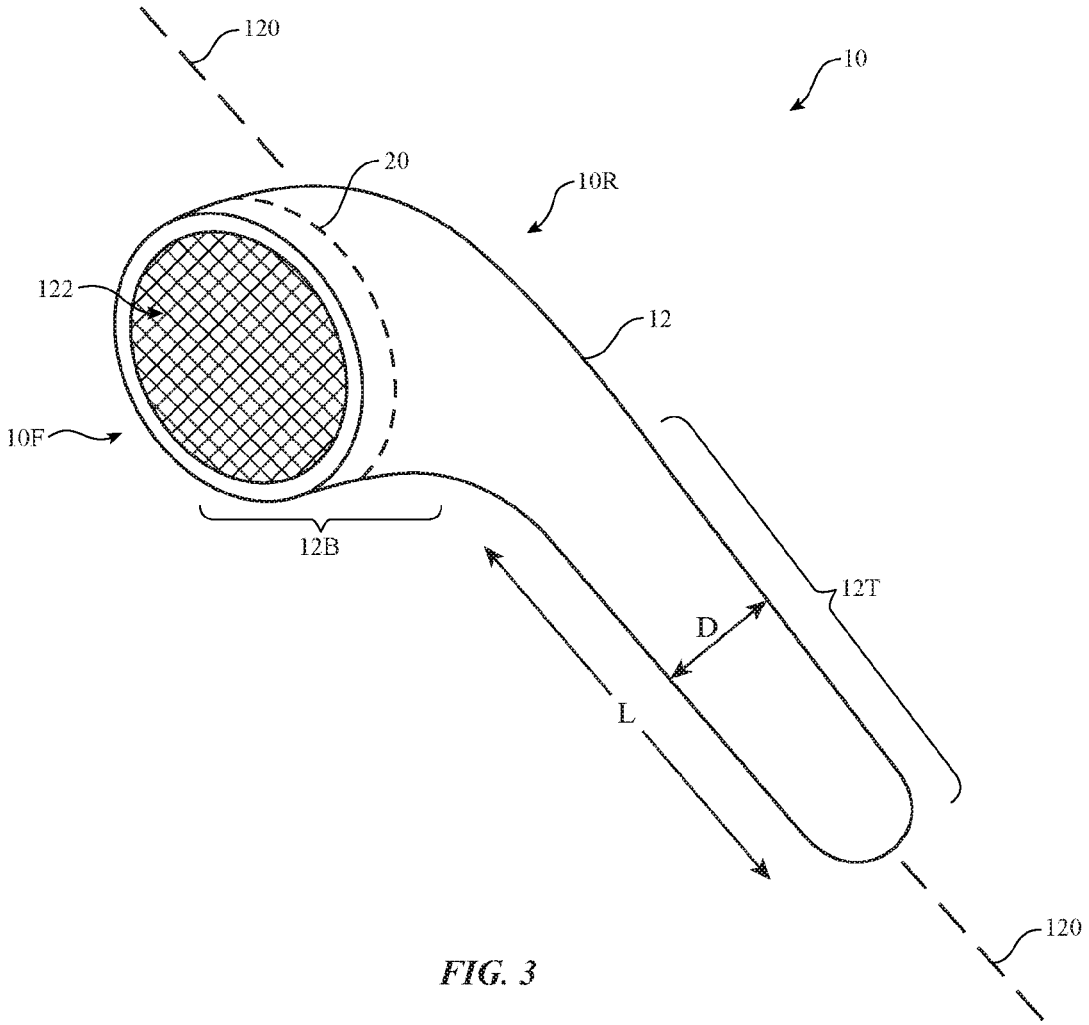
FIG. 3 is a front perspective view of an illustrative earbud in accordance with an embodiment.

A perspective view of device 10 in an illustrative configuration in which device 10 is a wireless earbud is shown in FIG. 3. As shown in FIG. 3, earbud 10 may have a front 10F and a rear 10R. Housing 12 may have a main portion such as main body portion 12B in which speaker port 122 is formed. Speaker port 122 may face the front of earbud 10 (i.e., port 122 may be formed in the surface of housing 12 at front 10F of earbud 10). An elongated protruding portion such as housing stalk portion 12T may extend outwardly from main housing portion 12B.

Main body portion 12B may have a shape that fits within the ear of a user. Speaker 20 may be mounted in main body portion 12B and may be aligned with speaker port 122. Speaker 20 may be used to provide sound to the ear of the user. Speaker port 122 may be formed from one or more openings in housing 12. One or more plastic or metal mesh layers may be interposed between speaker 20 and the opening(s) in housing 12 (e.g., to help prevent the intrusion of dust and other contaminants into speaker 20).

Housing 12 may be formed from metal, plastic, carbon-fiber composite material or other fiber composites, glass, ceramic, other materials, or combinations of these materials. Stalk 12T may be characterized by a length L and a diameter D (or other lateral dimension such as a width perpendicular to length L). The aspect ratio (L/D) of stalk 12T may be high (e.g., at least three, at least four, at least five, at least ten, less than 20, etc.). The elongated shape of stalk 12T may help allow a user to grasp earbud 10 when removing earbud 10 from the ear or when placing earbud 10 in the ear. Stalk 12T may extend from main body portion 12B at rear 10R of housing 12 and may extend along longitudinal stalk axis 120. If desired, stalk 12T may have a curved shape. The illustrative straight shape of FIG. 3 is merely illustrative.

Figure 4:
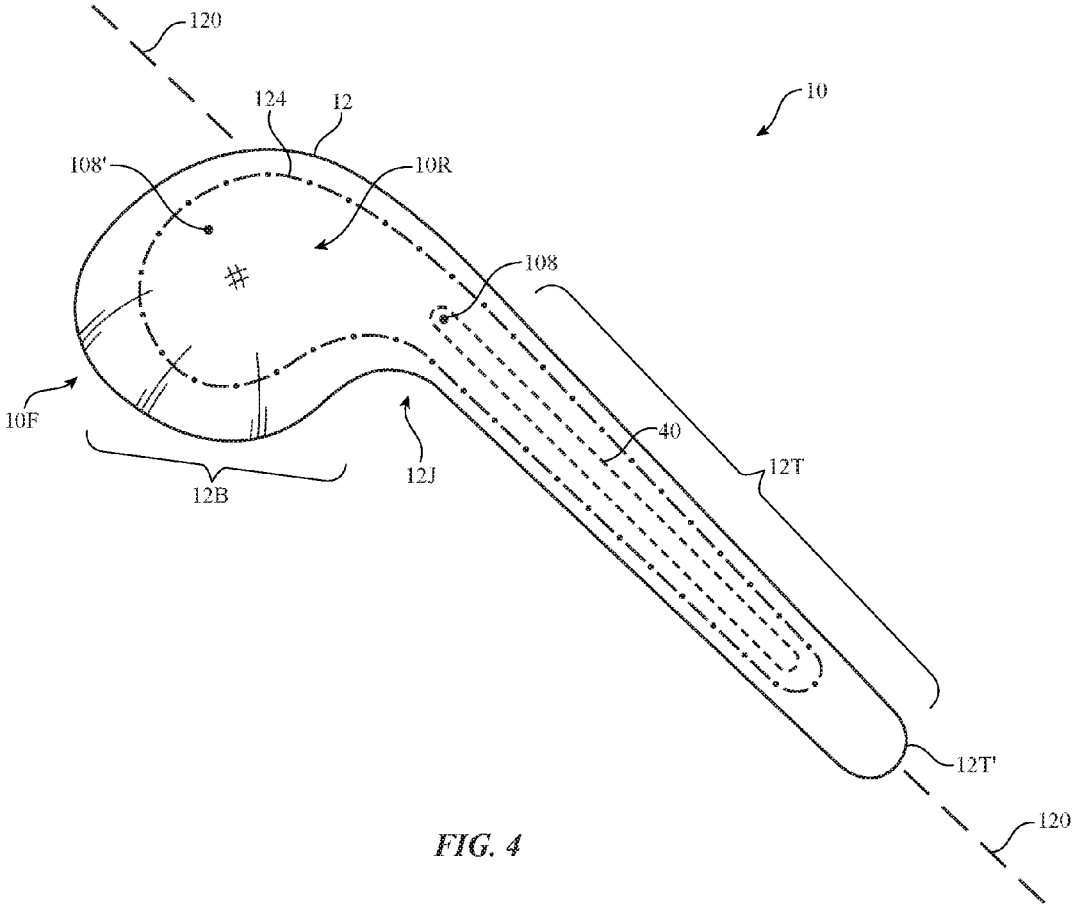
FIG. 4 is a rear perspective view of the illustrative earbud of FIG. 3 showing where an antenna may be located in the earbud accordance with an embodiment.

A rear perspective view of earbud 10 of FIG. 3 is shown in FIG. 4. As shown in FIG. 4, antenna 40 may have an elongated shape that runs along axis 120 parallel to the length of stalk 12T. Antenna 40 may extend along stalk 12T from feed 108 toward tip 12T' of stalk 12T.

Antenna 40 may, if desired overlap structures such as battery 26 and other conductive components that are located in interior region 124 of housing 12. These structures may contain conductive materials that tend to shield antenna 40. To ensure that antenna 40 operates satisfactorily, antenna 40 may run under a plastic stalk wall or other dielectric wall in housing 12 (i.e., just under the surface of housing 12 in stalk 12T), so that antenna resonating element arm 104 of antenna 40 is interposed between the battery and other conductive structures in region 124 and the dielectric housing wall. The battery and other conductive structures in region 124 may form part of antenna ground 102.

Antenna feed 108 may be located at juncture 12J of housing 12 between main body portion 12B and stalk 12T, rather than at a location that overlaps region 124 in main body portion 12B. Locating the antenna feed in location 108 of FIG. 4 at juncture 12J rather than other locations such as location 108' may help to minimize currents in battery 26 and other ground plane currents that might reduce antenna efficiency.

Antenna 40 may be formed from patterned metal traces on a printed circuit. The printed circuit may be a rigid printed circuit board (e.g., a printed circuit formed from a rigid printed circuit board substrate material such as fiberglass-filled epoxy) or may be a flexible printed circuit (e.g., a printed circuit formed from a flexible layer of polyimide or a sheet of other polymer substrate material).

Figure 5:
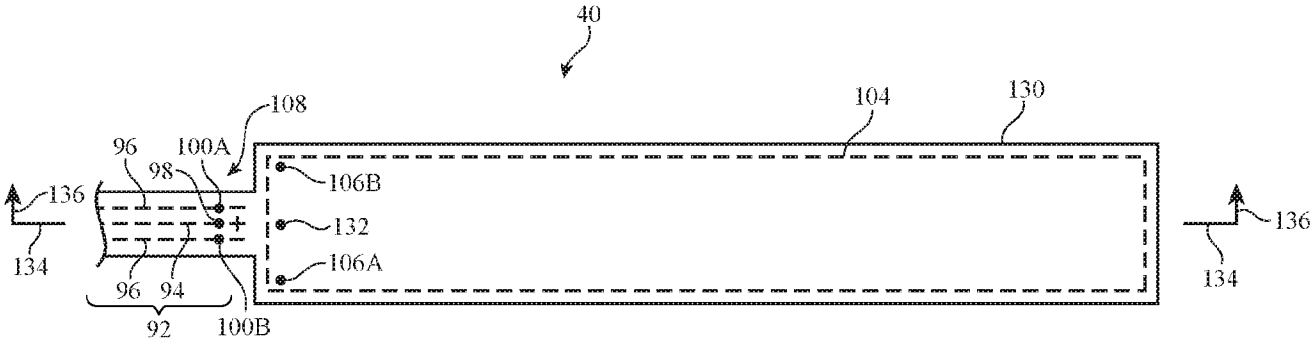
FIG. 5 is a top view of an illustrative printed circuit with traces that form an antenna in accordance with an embodiment.

FIG. 5 is a top view of an illustrative configuration for antenna 40 in which antenna 40 is formed from a printed circuit substrate. As shown in FIG. 5, antenna 40 may be formed from metal antenna traces on printed circuit substrate 130 such as metal traces that form antenna resonating element arm 104. Antenna 40 may be fed using transmission line 92. Transmission line 92 may include positive signal line structures such as conductive line 94, which is coupled to positive feed terminal 98 of feed 108 and ground signal conductors such as conductor(s) 106, coupled to ground feed terminal 100 of feed 108 (see, e.g., terminals 100A and 100B of FIG. 5 or other suitable antenna ground feed structures).

Terminals 98 and 100 may be coupled respectively to antenna resonating element arm 104 and ground 102 (see, e.g., FIG. 2) using metal traces in the printed circuit from which antenna 40 is formed (e.g., vias in substrate 130 such as via 132, metal traces on one or more dielectric layers in printed circuit substrate 130, etc.). A return path such as return path 106 of FIG. 2 may be formed using one or more vias in printed circuit substrate 130 such as illustrative return path vias 106A and 106B of FIG. 5.

Figure 6:
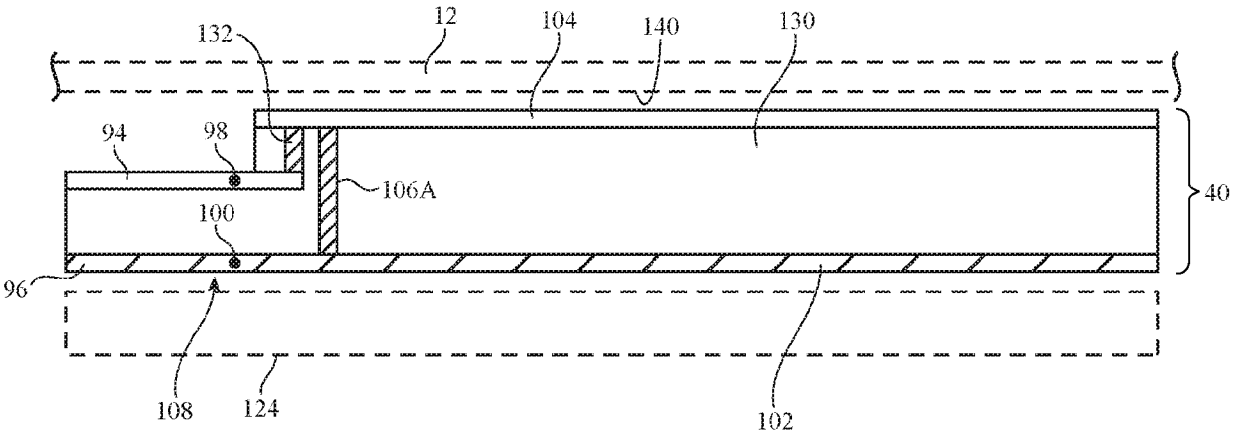
FIG. 6 is a side view of the illustrative antenna of FIG. 5 in accordance with an embodiment.

A cross-sectional side view of antenna 40 of FIG. 5 taken along line 134 and viewed in direction 136 is shown in FIG. 6. As shown in FIG. 6, antenna 40 may have a lower metal trace layer such as lower metal layer 102 that serves as antenna ground for antenna 40. Antenna 40 may also have a metal trace such as upper metal trace 104 on the opposing surface of printed circuit substrate 130 (i.e., on the upper surface of printed circuit substrate 130). Metal trace 104 may serve as antenna resonating element arm 104 of antenna resonating element 100 of FIG. 2. If desired, arm 104 may have multiple branches, may have bent portions, may include embedded capacitors, inductors, switches, or other components, may be formed in one or more layers of printed circuit 130, or may have other configurations. The illustrative configuration of FIG. 6 in which arm 104 is formed from a strip of metal on one surface of substrate 130 that runs parallel a strip of metal that forms ground 102 on an opposing surface of substrate 130 is merely illustrative.

As shown in FIG. 6, antenna feed terminal 98 may be coupled to arm 104 by a via such as via 132. Vias may also be used in forming return path 106 (FIG. 2), as shown by return path via 106A of FIG. 6. Vias such as illustrative return path via 106A of FIG. 6 may be shorted between the metal traces that form resonating element arm 104 and the traces that form antenna ground 102. The traces on the lower surface of printed circuit substrate 130 may be adjacent to conductive structures in region 124 (e.g., battery 26, etc.). The traces on the upper surface of printed circuit substrate 130 may be adjacent to inner surface 140 of housing 12 and may therefore be interposed between the wall of housing stalk portion 12T and substrate 130. In this configuration, housing 12 may have walls formed from a dielectric material such as plastic. During operation of antenna 40, antenna signals may be transmitted through the plastic wall of housing 12 and may be received through the plastic housing wall.

The foregoing is merely illustrative and various modifications can be made by those skilled in the art without departing from the scope and spirit of the described embodiments. The foregoing embodiments may be implemented individually or in any combination.

What is claimed is:

1. An earbud, comprising:

a housing having a main body portion with a speaker port and having a stalk that extends from the main body portion;

a speaker mounted in the main body portion in alignment with the speaker port;

a printed circuit substrate; and an antenna in the stalk, wherein the antenna comprises a metal trace on the printed circuit substrate, a transmission line is coupled to the metal trace through a via in the printed circuit substrate, the via is configured to pass antenna signals from a positive signal path of the transmission line to the metal trace, the positive signal path comprises a conductive line extending into the printed circuit substrate, the conductive line and the metal trace are formed in parallel planes, and the via is interposed between the conductive line and the metal trace.

2. The earbud defined in claim 1 wherein the antenna has an elongated shape and extends along the stalk.

3. The earbud defined in claim 2 wherein the antenna comprises an inverted-F antenna.

4. The earbud defined in claim 3 wherein the stalk has a plastic housing wall portion, wherein the earbud further comprises a conductive component in the stalk, and wherein the antenna is interposed between the conductive component and the plastic housing wall portion.

5. The earbud defined in claim 4 wherein the printed circuit substrate is adjacent to the plastic housing wall portion, and the antenna includes an additional metal trace on the printed circuit substrate that is adjacent to the conductive component.

6. The earbud defined in claim 5 wherein the metal trace comprises a resonating element arm and wherein the additional metal trace comprises an antenna ground.

7. The earbud defined in claim 6 wherein the antenna further comprises a return path via that passes through the printed circuit substrate between the resonating element arm and the antenna ground.

8. An electronic device, comprising:

a dielectric housing having a main body portion with a port and having an elongated protruding portion that extends from the main body portion along a longitudinal axis; and an electrical component aligned with the port; and an antenna in the dielectric housing that extends along the longitudinal axis within the elongated protruding portion, wherein the antenna comprises an antenna ground and first and second ground feed terminals that are coupled to the antenna ground at respective first and second locations, wherein the elongated antenna comprises a substrate having first and second opposing surfaces, a first metal trace on the first surface, and a second metal trace on the second surface.

9. The electronic device defined in claim 8 wherein the elongated protruding portion is characterized by a length, a width, and a length to width ratio of at least three.

10. The electronic device defined in claim 9 wherein the electrical component comprises a speaker and wherein the main body portion is configured to be received within an ear of a user.

11. The electronic device defined in claim 10 wherein the antenna comprises an inverted-F antenna having a resonating element arm that extends along the elongated protruding portion.

12. The electronic device defined in claim 8 further comprising a return path via that extends through the substrate from the first metal trace to the second metal trace.

13. The electronic device defined in claim 12 wherein the electrical component comprises a speaker and wherein the main body portion is configured to be received within an ear of a user.

14. A wireless earbud, comprising:

a speaker;

an inverted-F antenna; and a housing having a main body portion in which the speaker is mounted and having a stalk that protrudes from the main body portion in which the inverted-F antenna is mounted, wherein the inverted-F antenna includes a resonating element arm within the stalk and an antenna ground that includes a first portion within the stalk and a second portion within the main body portion of the housing.

15. The wireless earbud defined in claim 14 wherein the inverted-F antenna comprises a dielectric substrate having first and second surfaces, a first metal trace on the first surface, and a second metal trace on the second surface.

16. The wireless earbud defined in claim 15 further comprising a return path via that passes through the dielectric substrate from the first metal trace to the second metal trace.

17. The wireless earbud defined in claim 16 further comprising a battery in the housing, wherein the stalk comprises a plastic wall that lies adjacent to the first metal trace.

18. The wireless earbud defined in claim 14 wherein the main body portion is coupled to the stalk at a juncture in the housing and wherein the inverted-F antenna has a feed at the juncture.

* * * * *